United States Patent [19]

Duncan et al.

[11] Patent Number: 5,055,112

[45] Date of Patent: Oct. 8, 1991

[54] DIESEL PARTICULATE REDUCING 1,2-ALKANEDIOL ADDITIVES

[75] Inventors: Michael P. Duncan, Lockport, Ill.; Alexander M. Kulinowski, St. Louis, Mo.

[73] Assignee: Ethyl Petroleum Additives, Inc., St. Louis, Mo.

[21] Appl. No.: 428,997

[22] Filed: Oct. 30, 1989

[51] Int. Cl.[5] ..... C10L 1/18; C10L 10/00

[52] U.S. Cl. ..... 44/445

[58] Field of Search ..... 44/53, 57, 77, 445

[56] References Cited

U.S. PATENT DOCUMENTS

| | | | |
|---|---|---|---|
| 3,002,827 | 10/1961 | Fenske | 44/57 |
| 3,291,580 | 12/1966 | Malick | 44/53 |
| 3,817,720 | 6/1974 | Moy et al. | 44/57 |
| 4,378,973 | 4/1983 | Sweeney | 44/57 |
| 4,704,218 | 11/1987 | Horodysky et al. | 44/53 |
| 4,816,037 | 3/1989 | Horodysky et al. | 44/53 |
| 4,826,506 | 5/1989 | Vardi et al. | 44/77 |

*Primary Examiner*—Prince E. Willis
*Assistant Examiner*—Jerry D. Johnson
*Attorney, Agent, or Firm*—John F. Sieberth; E. E. Spielman; D. M. Thompson

[57] ABSTRACT

A diesel fuel composition comprising a major amount of a hydrocarbon based compression ignition fuel and a minor particulate-reducing amount of an aliphatic 1,2-diol.

5 Claims, No Drawings

DIESEL PARTICULATE REDUCING 1,2-ALKANEDIOL ADDITIVES

TECHNICAL FIELD

This invention relates to means for reducing particulate emissions during operation of compression ignition engines (commonly known as diesel engines).

BACKGROUND

Fuels used in diesel engines tend to produce exhausts containing undesirable particulates, both visible and invisible. For example, when the diesel engine is operated under heavy loads or when it is a worn or dirty engine, visible emission of smoke often occurs. Small particulates, invisible to the naked eye, can be and usually are emitted even when the combustion chamber and exhaust system of the engine are clean and the engine is operated under normal loads.

It is of course important to minimize the extent of such particulate emissions as much as possible. Some of the prior work along these lines is described in U.S. Pat. Nos. 3,817,720 and 4,378,973.

THE INVENTION

This invention provides a diesel fuel composition comprising a major amount of a hydrocarbon base compression ignition fuel and a minor particulate-reducing amount of an aliphatic 1,2-diol. The method of this invention involves supplying to and burning such fuel in a diesel engine.

The hydrocarbon based diesel fuels utilized in the practice of this invention are comprised in general of mixtures of hydrocarbons which fall within the diesel fuel boiling range, typically about 160° to about 370° C. The fuels are often referred to as middle distillate fuels since they comprise the fractions which distill after gasoline.

The base fuel will normally contain an amount in the range of 100 to about 50,000 and preferably, from about 500 to about 5,000—parts of the aliphatic 1,2-diol per million parts by weight of the base fuel (ppm). Such quantities are normally sufficient to reduce the amount of diesel particulate emission as compared to amount of particulate emission that occurs in the same engine operated under the same conditions on the same fuel composition absent the particulate-reducing additive of this invention.

Typical aliphatic 1,2-diols used in the practice of this invention are the acyclic hydrocarbons having vicinal hydroxyl groups in the one and two positions of the open chain, and which contain 6 to 24—and preferably 12 to 2013 carbon atoms in the molecule. The diols may be used singly or in combinations of two or more such diols. Most preferably the diols contain no unsaturation in the molecule. However some unsaturation is permissible provided this does not interfere with or markedly impair the functioning of the additive in suppressing the formation of particulate emissions during operation of the diesel engine. Illustrative additives include 1,2-hexanediol, 1,2-heptanediol, 1,2-octanediol, 1,2-nonanediol, 1,2-decanediol, 1,2-dodecanediol, 1,2-tetradecanediol, 1,2-hexadecanediol, 1,2-octadecanediol, 1,2-eicosanediol, 2-ethyl-1,2-hexanediol, and like 1,2-alkane diols. An advantageous feature of this invention is that since the diols are composed solely of carbon, hydrogen and oxygen they do not produce extraneous deposits in the combustion chamber or in the engine exhaust.

Conventional additives and blending agents for diesel fuel may be present in the fuel compositions of this invention. For example, the fuels of this invention may contain conventional quantities of such conventional additives as cetane improvers, friction modifiers, detergents, antioxidants, heat stabilizers, and the like. Similarly the fuels may contain suitable minor amounts of conventional fuel blending components such as methanol, ethanol, dialkyl ethers, and the like.

The effectiveness of this invention in alleviating the particulate emission problem in diesel engine operation was demonstrated by use of a single cylinder diesel engine fitted with an exhaust dilution tunnel and a particulate sampling system. The engine was operated on a typical commercial diesel fuel without the additive of this invention and the exhaust was analyzed for the weight of particulates which had collected on the filter used to capture the particulates from the exhaust. The system was then switched to another portion of the same base fuel with which had been blended a particulate-reducing additive of this invention, and again the particulates were collected and weighed. This procedure was repeated alternating between base fuel and additive-containing fuel in order to eliminate, or at least substantially minimize, fluctuations in results from one operation to the next.

Additives used and results obtained in such tests are tabulated below.

| Additive | Additive Concentration, ppm | Particulate Reduction, % |
|---|---|---|
| 1,2-tetradecanediol | 500 | 15 |
| 1,2-hexadecanediol | 500 | 10 |
| 1,2-octadecanediol | 500 | 16 |
| 1,2-eicosanediol | 500 | 11 |
| 1,2-eicosanediol | 2500 | 25 |

This invention is applicable to the operation of both stationary diesel engines (e.g., engines used in electrical power generation installations, in pumping stations, etc ) and in ambulatory diesel engines (e.g., engines used as prime movers in automobiles, trucks, road-grading equipment, military vehicles, etc.).

This invention is susceptible to considerable variation in its practice within the spirit and scope of the ensuing claims.

What is claimed is:

1. A method of claim 5 wherein said particulate-reducing amount is in the range of from about 500 to about 5,000 parts of 1,2-alkanediol per million parts of said fuel composition.

2. A method of claim 5 in which said 1,2-alkanediol has from 12 to 20 carbon atoms in the molecule.

3. A method of claim 5 in which said 1,2-alkane diol is one or more of the following: 1,2-tetradecanediol, 1,2-hexadecanediol, 1,2-octadecanediol, 1,2-eicosanediol.

4. A method of claim 5 in which said 1,2-alkane diol is 1,2-eicosanediol present in amount in the range of about 500 to about 2500 ppm based on the weight of the base fuel.

5. A method for reducing the amount of particulates in the exhaust of a diesel engine which comprises supplying to and burning in said engine a diesel fuel composition comprising a major amount of a hydrocarbon based compression ignition fuel and a minor particulate-reducing amount of a 1,2-alkanediol having from 6 to 24 carbon atoms in the molecule.

* * * * *